252-99 AU 157 EX
7/1/86 XR 4,597,886

United States Patent [19]
Goedhart et al.

[11] Patent Number: 4,597,886
[45] Date of Patent: Jul. 1, 1986

[54] DISHWASHING COMPOSITIONS

[75] Inventors: Machiel Goedhart, Rozenburg; Franciscus H. Gortemaker, Mijnsheerenland; Hermanus C. Kemper, Brielle; Hendrik S. Kielman, Maassluis, all of Netherlands

[73] Assignee: Lever Brothers Company, New York, N.Y.

[21] Appl. No.: 660,606

[22] Filed: Oct. 12, 1984

[30] Foreign Application Priority Data

Oct. 20, 1983 [GB] United Kingdom ..... 8328075

[51] Int. Cl.[4] ..... C11D 3/395; C11D 7/54; C11D 17/00

[52] U.S. Cl. ..... 252/95; 252/99; 252/174.12; 252/174.25; 252/140; 252/174.21; 252/DIG. 12

[58] Field of Search ..... 252/113, 120, 121, 128, 252/131, 140, 155, 173, 174.12, 174.21, 174.25, DIG. 14, 95, DIG. 12

[56] References Cited

U.S. PATENT DOCUMENTS

| | | | |
|---|---|---|---|
| 4,005,027 | 1/1977 | Hartmann | 252/95 |
| 4,116,851 | 9/1978 | Rupe et al. | 252/103 |
| 4,166,039 | 8/1979 | Wise | 252/133 |
| 4,243,543 | 1/1981 | Guilbert et al. | 252/105 |
| 4,397,755 | 8/1983 | Brierley et al. | 252/140 |

*Primary Examiner*—A. Lionel Clingman
*Assistant Examiner*—John F. McNally
*Attorney, Agent, or Firm*—Milton L. Honig; James J. Farrell

[57] ABSTRACT

By the inclusion of an effective level of a layered clay, e.g. a synthetic hectorite, in an enzymatic dishwashing composition, the formation of spots and films on the cleaned objects is significantly reduced.

2 Claims, No Drawings

DISHWASHING COMPOSITIONS

The present invention relates to cleaning compositions for housewares such as pots, pans, dishes, cups, saucers, bottles, glassware, crockery, kitchen utensils and other hard-surface housewares. Hereinafter, for brevity's sake, the compositions of the invention will be referred to as "dishwashing compositions", it being understood that this terminology shall embrace the cleaning of the articles as indicated above as well.

It is well known in the dishwashing art that the visual appearance of the cleaned article is a critical factor for a dishwashing composition to be satisfactory to the consumer. Frequently, after cleaning of an article a film is formed thereon, which results in the article showing a dull surface when dry, or spots are formed on an article after drying, both phenomena causing the article to have an "unclean" visual appearance.

Many proposals have already been made to reduce this film- and spot-formation. As it is generally believed that this film- and spot-formation is caused by precipitation of insoluble salts, primarily calcium salts, from the wash liquor onto the surface of the articles, these prior proposals mainly involve inactivation of the insoluble salt-forming cations by means of suitable sequestering agents. However, this does not always lead to products with a reduced film- and spot-formation; thus we have found that enzyme-containing dishwashing compositions, despite the presence therein of sodium tripolyphosphate, which is known to be a calcium sequestrant, give rise to spot-formation on glass articles to an undesired extent.

It is therefore an object of the present invention to provide enzymatic dishwashing compositions with a reduced tendency to form films and spots on the articles cleaned therewith. We have now surprisingly found that this and other objects of the present invention can be achieved by the inclusion in an enzymatic dishwashing composition of an effective level of a layered clay. The present invention will now be discussed in further detail hereunder.

The layered clay minerals suitable for use in the present invention belong to the geological classes of the smectites, the kaolins, the illites, the chlorites, the attapulgites and the mixed layer clays. Typical examples of specific clays belonging to these classes are:

- smectites, e.g. montmorillonite, bentonite, pyrophyllite, hectorite, saponite, sauconite, nontronite, talc, beidellite, volchonskoite, vermiculite;
- kaolins, e.g. kaolinite, dickite, nacrite, antigorite, anauxite, halloysite, indellite, chrysotile;
- illites, e.g. bravaisite, muscovite, paragonite, phlogopite, biotite;
- chlorites, e.g. corrensite, penninite, donbassite, sudoite, pennine, clinochlore;
- attapulgites, e.g. sepiolite, polygorskyte;
- mixed layer clays, e.g. allevardite, vermiculitebiotite.

The layered clay minerals may be either naturally occurring or synthetic. Preferred clay minerals for use in the present invention are natural or synthetic hectorites, montmorillonites and bentonites, and of these the hectorites are especially preferred. Many of the above clays are commercially available, and typical examples of commercial hectorites are the Laponites ex Laporte Industries Ltd, England; Veegum Pro and Veegum F ex R. T. Vanderbilt, U.S.A.; the Barasyms, Macaloids and Propaloids ex Baroid Division, National Read Comp., U.S.A.

Particularly preferred commercial hectorites are Laponite S, Laponite XLS, Laponite RD and Laponite RDS, of which Laponite XLS is especially preferred. This is a synthetic hectorite having the following characteristics: analysis (dry basis) $SiO_2$ 59.8%, MgO 27.2%, $Na_2O$ 4.4%, $Li_2O$ 0.8%, structural $H_2O$ 7.8%, with the addition of tetrasodium pyrophosphate (6%); specific gravity 2.53; bulk density 1.0.

The effective level of the layered clay to be included according to the present invention in the enzymatic dishwashing compositions ranges from 0.01-60% by weight, usually from 0.1 to 50% by weight. Preferably it ranges from 0.5 to 25%, and particularly preferably from 0.5-5% by weight.

THE ENZYMATIC DISHWASHING COMPOSITION

The enzymatic dishwashing compositions of the invention contain, as essential ingredients, enzymes, alkaline salts and detergent-active materials. As enzymes, proteolytic, amylolytic, lipolytic and cellulolytic enzymes can be used, as well as mixtures of such enzymes. The enzymes may be of any suitable origin, such as vegetable, animal, bacterial, fungal and yeast origin. Preferably they are of bacterial and fungal origin.

Suitable examples of proteolytic enzymes are the subtilisins which are obtained from particular strains of *B. subtilis* and *B. licheniformis*, such as the commercially available Maxatase® (ex Gist-Brocades N. V., Delft, Holland) and Alcalase® (ex Novo Industri A/S, Copenhagen, Denmark). Particularly suitable are proteases obtained from a strain of Bacillus having maximum activity in the $p_H$ range of 8-12, developed and sold by Novo Industri A/S under the registered trade-names Esperase® and Savinase®. The preparation of such enzymes is described in British patent specification No. 1,243,784.

Suitable examples of amylolytic enzymes are commercially available amylases such as Maxamyl® (ex Gist-Brocades) and Termamyl® (ex Novo Industri A/S). Amylases as described in British patent specification No. 1,296,839 are also suitable.

Typical examples of commercial lipolytic enzymes are e.g. Lipase YL, Amano CE, Wallerstein AW, Lipase MY etc and typical examples of cellulolytic enzymes are cellulases ex *Humiscola insolens* as described in German patent application No. 3,117,250.

The compositions of the invention preferably contain proteolytic and/or amylolytic enzymes, and especially preferably a mixture of proteolytic and amylolytic enzymes.

Usually the amount of enzymes present in the composition is dictated by the enzymatic activity of the enzymes. The higher the activity, the lower the level of enzymes required in the composition. In general, the amount will vary between 0.001 and 10%, and for most practical purposes between 0.1 and 5% by weight of the composition.

The compositions of the invention furthermore contain one or more alkali salts commonly used in dishwashing compositions. Thus, they may contain organic and/or inorganic builder salts such as the alkali metal ortho-, pyro- and tripolyphosphates and hexametaphosphates, silicates, carbonates, borates, citrates, carboxymethyloxysuccinates, nitrilotriacetates and ethylenediaminetetraacetates, polymeric polyelectrolytes such as polyacrylates, polymaleates, and other known organic and inorganic builder compounds.

Usually, the amount of alkali salts in the compositions varies from 10–90% by weight, generally from 30–70% by weight.

The compositions of the invention may also contain a detergent-active compound. If a detergent-active compound is included, it usually is in an amount of from 0.5–10%, usually 1–5%. Any well-known type of detergent active compound may be used, such as soaps, synthetic anionic, nonionic, amphoteric detergent surfactant and mixtures thereof. Preferably, a nonionic detergent surfactant is used, especially a low-foaming one. Suitable examples of such nonionic detergent surfactants can easily be found in M. Schick "Nonionic Surfactants" (1967).

The compositions may furthermore contain other useful additives such as bleaching agents, bleaching agent activators, enzyme-stabilising agents, hydrotropes, fillers, perfumes, colouring agents, germicides, soil-suspending agents, aminopolyphosphonic acids and alkali metal or alkaline earth metal salts thereof, anticorrosion agents such as fatty acids, benztriazole and so on.

Since enzymes are usually incompatible with active chlorine-releasing agents, they should either be protected against attack by these bleaching agents, e.g. by encapsulating them, or alternatively a peroxygen bleaching agent should be used instead of a chlorine-releasing bleaching agent. Particularly preferred in the present invention is the use of a persalt together with a bleach activator, such as sodium perborate tetrahydrate or monohydrate together with tetraacetylethylenediamine. The presence of alkali metal or alkaline earth metal salts of aminopolyphosphonic acids such as the calcium salt of ethylenediaminetetraphosphonic acid is also preferred because of its stabilising effect on the percompounds.

The compositions of the invention are particularly useful for machine dishwashing operations. They can be formulated to any desired physical shape, such as powders, granules, tablets, blocks, liquids, etc.

The products of the present invention are formulated such that they provide a wash liquor with a $p_H$ of between 7 and 12, preferably between 9 and 11 and especially preferably between 10 and 10.5 (at a concentration of 0.3% in water).

The present invention will now be further illustrated by way of example.

EXAMPLE 1

The following particulate products were prepared:

| | A | B |
|---|---|---|
| sodium tripolyphosphate | 43.0 | 43.0 |
| sodium carbonate | 15.0 | 15.0 |
| sodium disilicate | 5.0 | 5.0 |
| tetraacetylethylenediamine | 4.2 | 4.2 |
| sodium perborate tetrahydrate | 11.0 | 11.0 |
| tricalcium ethylenediaminetetraphosphonate | 0.7 | 0.7 |
| Termamyl ® (amylase with activity of 3.8 MU/mg) | 3.5 | 3.5 |
| Esperase ® (protease with activity of 675 GU/mg) | 2.2 | 2.2 |
| $C_{12}$–$C_{15}$ OXO-alcohol, condensed with 4.4 moles of ethylene oxide and 6.3 moles of propylene oxide | 1.5 | 1.5 |
| Laponite ® XLS | — | 5.0 |
| sodium sulphate | 14.0 | 14.0 |
| water to | 100.0 | 100.0 |

Both formulations A and B were used in a dishwashing experiment, using a Miele G 550 dishwashing machine. A standard set of dishware, soiled with a standard evaluation soil, was cleaned ten times, using tapwater of 8° German hardness, without using a water-softener or a rinse aid. The dosage was 2 g/l. The washing programme was the normal programme at 65° C.

The film- and spot-formation were assessed visually according to the following scale:

| film formation | spot formation |
|---|---|
| 1 = no film | 1 = no spots |
| 2 = light film | 2 = 1–5 spots |
| 3 = clear film | 3 = 6–10 spots |
| 4 = thick film | 4 = 11–20 spots |
| | 5 = more than 20 spots |

The glasses cleaned with product A had a spot-score of between 4 and 5 (=about 20 spots per glass) and a film-score of around 1.5. With product B a spot-score of about 1.3 was obtained, and the film-score was the same as with product A.

EXAMPLE 2

In the same manner as in Example 1, the spot-formation of product A was compared with product A, to which varying levels of various clays were added. In this experiment another dishwashing machine was used, the Bosch M 500, and the conditions were as follows: main wash temperature 70° C., main wash liquor 8 l, the dosage of the dishwashing composition was 30 g and as soil 1.5 g/l of egg-yolk was added. The following clays were used at 1, 2.5 and 5.0% levels:

Bentone EW (a synthetic hectorite)
Hectorite 200 (a coarse, reformed natural hectorite)
Coaguloid (a natural hectorite)
Mineral Colloid BP (a montmorillonite)
Laponite XLS The following results were obtained:

| | Clay level (%) | | | |
|---|---|---|---|---|
| | 5 | 2.5 | 1 | 0 |
| Product | spot formation | | | |
| A | — | — | — | 4.0 |
| A + Bentone EW | 1.5 | 1.8 | 1.6 | |
| A + Hectorite 200 | 1.9 | 2.6 | 2.3 | |
| A + Coaguloid | 2.2 | 2.9 | 2.4 | |
| A + Mineral Colloid BP | 1.3 | 1.9 | 2.8 | |
| A + Laponite XLS | — | 1.7 | 1.0 | |

EXAMPLE 3

In the same manner as in Example 2, using water of 9° German hardness and as soil 12 g egg-yolk, formulation A was compared with the same formulation to which was added 5% Attagel (an attapulgite), or 5% Thixogel (a bentonite). The following results were obtained:

| | Spot formation | Film formation |
|---|---|---|
| A | 3.1 | 2.0 |
| A + 5% Attagel | 1.8 | 2.0 |

-continued

| | Spot formation | Film formation |
|---|---|---|
| A + 5% Thixogel | 1.6 | 1.8 |

EXAMPLE 4

The following formulation was tested at various pH-values in the following manner:

| | | |
|---|---|---|
| sodium tripolyphosphate | 40.0 | |
| sodium carbonate | 10.0 | |
| sodium disilicate | 10.0 | |
| tetraacetylethylenediamine | 4.0 | |
| sodium perborate tetrahydrate | 10.0 | |
| tricalcium ethylenediaminetetraphosphonate | 0.7 | |
| Termamyl ® (amylase with activity of 5.4 MU/mg) | 1.0 | |
| Esperase ® (protease with activity of 651 GU/mg) | 1.0 | |
| $C_{12}$–$C_{15}$ OXO-alcohol, condensed with 4.4 moles of ethylene oxide and 6.3 moles of propylene oxide | 1.5 | |
| Laponite ® XLS | 5.0 | |
| sodium sulphate | 15.0 | |
| water to | 100.0 | 100.0 |

The formulations were adjusted to a pH of 7.0, 9.0, 10.5 and 12.0 and tested in a Mad 1 Bosch E 700 dishwashing machine, using 8 l water of 9° German hardness at a temperature of 70° C. The dosage was 30 g per run, the soil was 12 g egg-yolk per machine run.

The following results were obtained after 2 runs:

| | | spot formation | film formation |
|---|---|---|---|
| product with Laponite XLS at pH | 7.0 | 5 | 3 |
| | 9.0 | 5 | 3 |
| | 10.5 | 1.1 | 2.2 |
| | 12.0 | 1.6 | 2.9 |
| product without Laponite XLS at pH | 7.0 | 5 | 2.5 |
| | 9.0 | 5 | 2.5 |
| | 10.5 | 4.6 | 2.5 |
| | 12.0 | 4.1 | 2.5 |

EXAMPLE 5

Using the formulation of Example 4 in the test of Example 2 with 12 g egg-yolk as soil, various levels of Laponite XLS and Attagel were tested. The following results were obtained:

| % clay | Laponite XLS | Attagel |
|---|---|---|
| | Spot formation | |
| — | 7.6 | 7.7 |
| 1 | 4.5 | 5.8 |
| 5 | 1.4 | 2.7 |
| 20 | 1.1 | 1.0 |
| | Film formation | |
| — | 1.8 | 1.7 |
| 1 | 1.9 | 2.0 |
| 5 | 1.9 | 2.0 |
| 20 | 2.0 | 2.0 |

EXAMPLE 6

Using the following clays instead of Laponite XLS in the formulation of Example 1 produces similar results: kaolinite, halloysite, montmorillonite, hectorite, attapulgite and sepiolite.

We claim:

1. A powdered enzymatic mechanical dishwashing composition with a reduced tendency to spot- and film-formation consisting essentially of:

(a) from 1–5% by weight of a nonionic detergent surfactant;

(b) from 10–90% by weight of an alkali salt selected from the group consisting of the organic and inorganic builder salts;

(c) from 0.001–10% by weight of an enzyme selected from the group consisting of amylases, proteases, lipases, cellulases and mixtures thereof;

(d) from 0.5–60% by weight of a layered clay, said clay being a synthetic hectorite; and (e) a bleaching agent present in an effective amount to clean dishes;

said composition having a pH between 10 and 12 at 3 g/l in aqueous solution.

2. The composition of claim 1, comprising 1–5% of (a), 30–70% of (b), 0.1–5% of (c) and 0.5–25% of (d).

* * * * *